US011503683B2

(12) United States Patent
Kim et al.

(10) Patent No.: US 11,503,683 B2
(45) Date of Patent: Nov. 15, 2022

(54) LIGHTING DEVICE AND CONTROLLING METHOD THEREOF

(71) Applicant: SOLUM CO., LTD., Yongin-si (KR)

(72) Inventors: Jurae Kim, Suwon-si (KR); Jeonggye Lim, Suwon-si (KR); Eunji Kim, Yongin-si (KR)

(73) Assignee: SOLUM CO., LTD., Yongin-si (KR)

( * ) Notice: Subject to any disclaimer, the term of this patent is extended or adjusted under 35 U.S.C. 154(b) by 0 days.

(21) Appl. No.: 17/322,791

(22) Filed: May 17, 2021

(65) Prior Publication Data

US 2022/0039229 A1 Feb. 3, 2022

(30) Foreign Application Priority Data

Jul. 31, 2020 (KR) ..... 10-2020-0095858
Dec. 15, 2020 (KR) ..... 10-2020-0175844

(51) Int. Cl.
*H05B 45/20* (2020.01)
*H05B 47/175* (2020.01)
*H05B 45/10* (2020.01)

(52) U.S. Cl.
CPC ..... *H05B 45/20* (2020.01); *H05B 45/10* (2020.01); *H05B 47/175* (2020.01)

(58) Field of Classification Search
CPC ..... H05B 45/20; H05B 47/175; H05B 45/10
See application file for complete search history.

(56) References Cited

U.S. PATENT DOCUMENTS 7,936,135 B2 5/2011 Hum et al.
9,844,113 B2 12/2017 Yan et al.
2014/0055041 A1* 2/2014 Ramer ..... H05B 47/11 315/153
2017/0223800 A1* 8/2017 Wu ..... H05B 45/00
(Continued)

FOREIGN PATENT DOCUMENTS

JP 2009530790 A 8/2009
JP 6002699 B2 10/2016
KR 20140132491 A 11/2014
(Continued)

OTHER PUBLICATIONS

Final Office Action for U.S. Appl. No. 17/322,840, filed May 17, 2021, on behalf of Solum Co., Ltd. dated Apr. 28, 2022. 13 Pages.

*Primary Examiner* — Minh D A
(74) *Attorney, Agent, or Firm* — Steinfl + Bruno LLP

(57) ABSTRACT

A lighting device is disclosed. The lighting device includes a first light emitting element having a first color temperature, a second light emitting element having a second color temperature, a communication interface, and a processor configured to, when a first user input for adjusting a brightness of the lighting device is received via the communication interface, adjust both brightness of the first light emitting element and the second light emitting element based on the first user input, when a second user input for adjusting a color temperature is received, obtain ratio information of the brightness of the first light emitting element to the brightness of the second light emitting element based on the second user input, and adjust both brightness of the first light emitting element and the second light emitting element based on the obtained ratio information.

9 Claims, 14 Drawing Sheets

(56) References Cited

U.S. PATENT DOCUMENTS

| | | | | |
|---|---|---|---|---|
| 2017/0238392 | A1* | 8/2017 | Shearer | H05B 45/10 315/153 |

FOREIGN PATENT DOCUMENTS

| | | | |
|---|---|---|---|
| KR | 101584936 | B1 | 1/2016 |
| KR | 101648788 | B1 | 8/2016 |
| KR | 101738784 | B1 | 5/2017 |
| KR | 101826752 | B1 | 3/2018 |
| KR | 102094860 | B1 | 3/2020 |
| WO | 2007/107958 | A1 | 9/2007 |

* cited by examiner

FIG. 4

405

| | BRIGHTNESS | W-LED | C-LED |
|---|---|---|---|
| case 1 | 100 | 0 | 100 |
| case 2 | 100 | 25 | 75 |
| case 3 | 100 | 50 | 50 |
| case 4 | 100 | 75 | 25 |
| case 5 | 100 | 100 | 0 |

FIG. 5

505

| | W:C=1:4 | | |
|---|---|---|---|
| | BRIGHTNESS | W-LED | C-LED |
| case 1 | 0 | 0 | 0 |
| case 2 | 50 | 10 | 40 |
| case 3 | 100 | 20 | 80 |

510

| | W:C=1:1 | | |
|---|---|---|---|
| | BRIGHTNESS | W-LED | C-LED |
| case 1 | 0 | 0 | 0 |
| case 2 | 50 | 25 | 25 |
| case 3 | 100 | 50 | 50 |

515

| | W:C=4:1 | | |
|---|---|---|---|
| | BRIGHTNESS | W-LED | C-LED |
| case 1 | 0 | 0 | 0 |
| case 2 | 50 | 40 | 10 |
| case 3 | 100 | 80 | 20 |

LIGHTING DEVICE AND CONTROLLING METHOD THEREOF

CROSS-REFERENCE TO RELATED APPLICATION

This application is based on and claims priority under 35 U.S.C. § 119 to Korean Patent Application Nos. 10-2020-0095858 and 10-2020-0175844, filed on Jul. 31, 2020 and Dec. 15, 2020, in the Korean Intellectual Property Office, the disclosures of which are incorporated by reference herein in their entireties.

BACKGROUND

1. Field

The disclosure relates to a lighting device and a controlling method thereof, and more particularly to a lighting device for controlling a plurality of light emitting elements having color temperatures different from each other and a method for controlling thereof.

2. Description of Related Art

In an example, a lighting device may include a light emitting element having one color temperature. Herein, a user may control a power state and a brightness of the light emitting element having one color temperature. With respect to the lighting device which emits light at one color temperature, a user may determine whether to increase or decrease the brightness.

In another example, the lighting device may include a plurality of light emitting devices having color temperatures different from each other. Herein, the user may adjust the color temperature of the plurality of light emitting elements having color temperatures different from each other, in addition to the brightness thereof. For example, the lighting device may include a plurality of light emitting elements having color temperatures of warm white (3,000 K), cool white (4,000 K), and daylight (6,500 K). Herein, the user may individually adjust the brightness of the light emitting element having each color temperature.

In particular, the lighting device may set a specific mode by combining the color temperatures. If the user selects a specific mode, the lighting device may emit light at a color temperature corresponding to the specific mode. However, in this case, the brightness is set based on a predetermined value, and accordingly accurate control may not be performed by the user and the brightness may not be consecutively changed.

In other words, there was inconvenience that the user had to control each of the light emitting elements at color temperatures different from each other or the lighting device had to be used only at a brightness and a color temperature corresponding to the predetermined mode.

SUMMARY

The disclosure has been made in view of the above problems, and an object of the disclosure is to provide a lighting device for controlling both a first light emitting element having a first color temperature and a second light emitting element having a second color temperature based on a user input for adjusting the first color temperature, and a method for controlling thereof.

In accordance with an embodiment for achieving the above object, there is provided a lighting device including a first light emitting element having a first color temperature, a second light emitting element having a second color temperature, a communication interface, and a processor configured to, when a first user input for adjusting a brightness of the lighting device is received via the communication interface, adjust both brightness of the first light emitting element and the second light emitting element based on the first user input, when a second user input for adjusting a color temperature is received, obtain ratio information of the brightness of the first light emitting element to the brightness of the second light emitting element based on the second user input, and adjust both brightness of the first light emitting element and the second light emitting element based on the obtained ratio information.

The processor may be configured to, when the first user input for increasing the brightness of the lighting device is received, control the brightness of the first light emitting element and the second light emitting element so as to increase both the brightness of the first light emitting element and the brightness of the second light emitting element.

The processor may be configured to, when the second user input for decreasing the color temperature is received, increase the brightness of the first light emitting element and decreasing the brightness of the second light emitting element.

The processor may be configured to, identify an entire supply current corresponding to the brightness of the lighting device based on the first user input, and supply the identified entire supply current to the first light emitting element and the second light emitting element based on the obtained ratio information.

The processor may be configured to, identify a first current supplied to the first light emitting element and a second current supplied to the second light emitting element based on the entire supply current and the ratio information, identify whether at least one of the entire supply current, the first current, or the second current is in a threshold range, and when at least one of the entire supply current, the first current, or the second current is identified to be beyond the threshold range, identify that the lighting device is broken down.

The processor may be configured to, obtain a first control signal corresponding to the first color temperature based on the entire supply current and the ratio information, obtain a second control signal corresponding to the second color temperature by inverting a waveform of the identified first control signal, transmit the first control signal to the first light emitting element, and transmit the second control signal to the second light emitting element.

The lighting device may further include a first switching element and a second switching element, the processor is configured to supply the first current to the first light emitting element via the first switching element based on the first control signal, and supply the second current to the second light emitting element via the second switching element based on the second control signal.

The lighting device may further include an output terminal including an LED positive electrode output terminal, an LED negative electrode output terminal, a first color temperature output terminal, and a second color temperature output terminal, the LED positive electrode output terminal may be connected to a positive electrode (anode) of the first light emitting element and a positive electrode (anode) of the second light emitting element, the first color temperature output terminal may be connected to a negative electrode (cathode) of the first light emitting element, the second color temperature output terminal may be connected to a negative electrode (cathode) of the second light emitting element, and the LED negative electrode output terminal may be connected to the negative electrode (cathode) of the first light emitting element, if the brightness is controlled only by the first light emitting element, without the second light emitting element.

The lighting device may further include a red light emitting diode, a green light emitting diode, and a blue light emitting diode, the output terminal may further include a red output terminal, a green output terminal, and a blue output terminal, the LED positive electrode output terminal may be connected to a positive electrode (anode) of the red light emitting diode, a positive electrode (anode) of the green light emitting diode, and a positive electrode (anode) of the blue light emitting diode, the red output terminal may be connected to a negative electrode (cathode) of the red light emitting diode, the green output terminal may be connected to a negative electrode (cathode) of the green light emitting diode, and the blue output terminal may be connected to a negative electrode (cathode) of the blue light emitting diode.

The lighting device may further include an auxiliary power supply, and the processor may be configured to, when power of the lighting device is turned off, supply the power to the lighting device by using the auxiliary power supply.

BRIEF DESCRIPTION OF THE DRAWINGS

The above and other aspects, features, and advantages of certain embodiments of the present disclosure will be more apparent from the following detailed description taken in conjunction with the accompanying drawings, in which:

FIG. 4 is a table for describing a relationship between a brightness of a first light emitting element and a brightness of a second light emitting element, in a case where the entire brightness is constant;

FIG. 5 is a table for describing a relationship between a brightness of a first light emitting element and a brightness of a second light emitting element, in a case where the entire brightness is different;

DETAILED DESCRIPTION

Hereinafter, the disclosure will be described in detail with reference to the accompanying drawings.

The terms used in embodiments of the disclosure have been selected as widely used general terms as possible in consideration of functions in the disclosure, but these may vary in accordance with the intention of those skilled in the art, the precedent, the emergence of new technologies and the like. In addition, in a certain case, there may also be an arbitrarily selected term, in which case the meaning will be described in the description of the disclosure. Therefore, the terms used in the disclosure should be defined based on the meanings of the terms themselves and the contents throughout the disclosure, rather than the simple names of the terms.

In this disclosure, the terms such as "comprise", "may comprise", "consist of", or "may consist of" are used herein to designate a presence of corresponding features (e.g., constituent elements such as number, function, operation, or part), and not to preclude a presence of additional features.

It should be understood that the expression such as "at least one of A or/and B" expresses any one of "A", "B", or "at least one of A and B".

The expressions "first," "second" and the like used in the disclosure may denote various elements, regardless of order and/or importance, and may be used to distinguish one element from another, and does not limit the elements.

If it is described that a certain element (e.g., first element) is "operatively or communicatively coupled with/to" or is "connected to" another element (e.g., second element), it should be understood that the certain element may be connected to the other element directly or through still another element (e.g., third element).

Unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

A term such as "module" or a "unit" in the disclosure may perform at least one function or operation, and may be implemented as hardware, software, or a combination of hardware and software. Further, except for when each of a plurality of "modules", "units", and the like needs to be realized in an individual hardware, the components may be integrated in at least one module and be implemented in at least one processor (not illustrated).

In this disclosure, a term "user" may refer to a person using a lighting device or a device using a lighting device (e.g., an artificial intelligence lighting device).

Hereinafter, an embodiment of the disclosure will be described in more detail with reference to the accompanying drawings.

Figure 1:
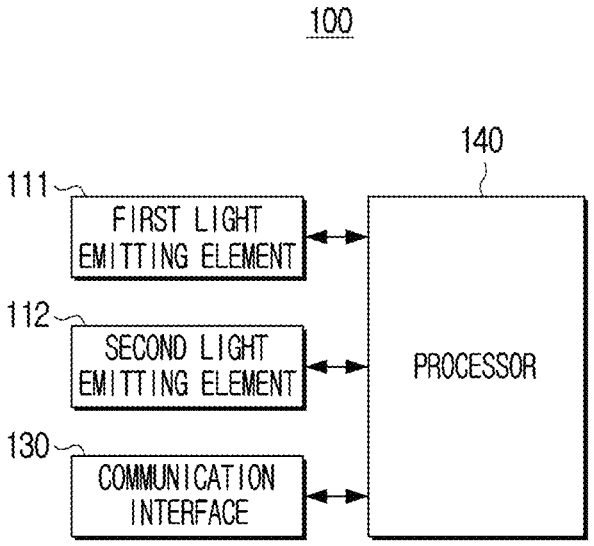
FIG. 1 is a block diagram illustrating a lighting device according to an embodiment.

FIG. 1 is a block diagram illustrating a lighting device according to an embodiment.

Referring to FIG. 1, a lighting device 100 may be configured with a first light emitting element 111, a second light emitting element 112, a communication interface 130, and a processor 140.

The lighting device 100 may refer to a device including light emitting elements. For example, the lighting device may refer to a device including a fluorescent lamp, a light bulb, a light emitting diode (LED), and the like.

According to an embodiment, the lighting device 100 may refer to a control circuit device for controlling a light emitting element. Accordingly, the lighting device 100 may be a device not including a light emitting element but configured with a circuit and an output terminal for controlling a light emitting element.

According to another embodiment, the lighting device 100 may be a device including a light emitting element. Accordingly, the lighting device 100 may refer to a device including both a light emitting element and a circuit for controlling the light emitting element.

The first light emitting element 111 may refer to an element for emitting light at a first color temperature. Herein, the first light emitting element 111 may refer to a first light emitting type element and the first light emitting element 111 may refer to an element for emitting warm type light. The warm type light (light source) herein may refer to light (light source) having a color temperature lower than 4,000 K.

The second light emitting element 112 may refer to an element for emitting light at a second color temperature. The second light emitting element 112 herein may refer to a second light emitting type element and the second light emitting element 112 may refer to an element for emitting cold type light. The cold type light (light source) herein may refer to light (light source) having a color temperature of 4,000 K or higher.

The communication interface 130 may be configured to communicate with various types of external devices according to various types of communication methods. For example, the communication interface 130 may include a Wi-Fi module, a Bluetooth module, an infrared communication module, a wireless communication module, and the like. The Wi-Fi module and the Bluetooth module may communicate by a Wi-Fi method and a Bluetooth method, respectively. The wireless communication module may include at least one communication chip for executing communication based on various wireless communication standards such as Zigbee, 3rd Generation (3G), 3rd Generation Partnership Project (3GPP), Long Term Evolution (LTE), LTE Advanced (LTE-A), 4th generation (4G), 5th generation (5G) and the like, in addition to the communication method described above.

Herein, the communication interface 130 may receive a user input. Specifically, the lighting device 100 may receive a user input from a remote control device communicating with the lighting device 100 via the communication interface 130.

The processor 140 may perform a general control operation of the lighting device 100. Specifically, the processor 140 may function to control general operations of the lighting device 100.

The processor 140 may be implemented as a digital signal processor (DSP), a microprocessor, or a time controller (TCON) for processing digital signals. However, there is no limitation thereto, and the processor may include one or more of a central processing unit (CPU), a microcontroller unit (MCU), a microprocessing unit (MPU), a controller, an application processor (AP), a graphics processing unit (GPU), or a communication processor (CP), and an ARM processor or may be defined as the corresponding term. In addition, the processor 140 may be implemented as System on Chip (SoC) or large scale integration (LSI) including the processing algorithm or may be implemented in form of a field programmable gate array (FPGA). The processor 140 may perform various functions by executing computer executable instructions stored in the memory.

When a first user input for adjusting the brightness of the lighting device 100 is received via the communication interface 130, the processor 140 may adjust both brightness of the first light emitting element 111 and the second light emitting element 112 based on the first user input, and when a second user input for adjusting the color temperature is received, the processor 140 may obtain ratio information of the brightness of the first light emitting element 111 to the brightness of the second light emitting element 112 based on the second user input, and adjust both the brightness of the first light emitting element 111 and the second light emitting element 112 based on the obtained ratio information.

Meanwhile, when the first user input for increasing the brightness of the lighting device 100 is received, the processor 140 may control the brightness of the first light emitting element 111 and the second light emitting element 112 so as to increase both the brightness of the first light emitting element 111 and the brightness of the second light emitting element 112.

Meanwhile, when the second user input for decreasing the color temperature is input, the processor 140 may control the brightness of the first light emitting element 111 and the second light emitting element 112 so as to increase the brightness of the first light emitting element 111 and decrease the brightness of the second light emitting element 112.

Herein, the first light emitting element 111 may refer to an element for emitting warm type light and the second light emitting element 112 may refer to an element for emitting cold type light.

Herein, the first user input may be a control command for adjusting the entire brightness of the lighting device 100. In addition, the second user input may be a control command for adjusting the color temperature of the lighting device 100. Herein, the user input for adjusting the color temperature may be a control command for selecting whether to control to emit light at a warm type color temperature or to control to emit light at a cold type color temperature regarding the entire color temperature of the lighting device 100.

When the second user input for changing the color temperature is received, the processor 140 may adjust the entire color temperature by adjusting the brightness of the first light emitting element 111 and the brightness of the second light emitting element 112. For example, when the user input for adjusting the entire color temperature to the warm type is received, the processor 140 may increase the brightness of the first light emitting element 111 and decrease the brightness of the second light emitting element 112. In addition, when the user input for adjusting the entire color temperature to the cold type is received, the processor 140 may decrease the brightness of the first light emitting element 111 and increase the brightness of the second light emitting element 112.

Figure 8:
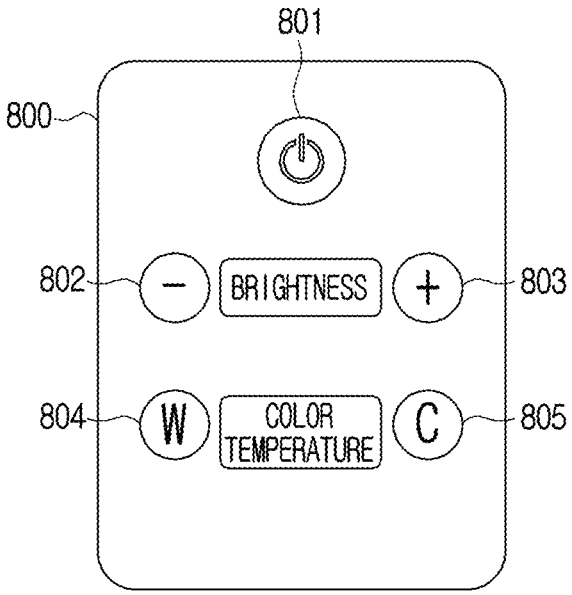
FIG. 8 is a diagram illustrating a remote control device communicating with a lighting device according to an embodiment.

Meanwhile, the first user input for adjusting the entire brightness may be a control signal corresponding to an action in which a button 802 or a button 803 of FIG. 8 is selected.

Figure 12:
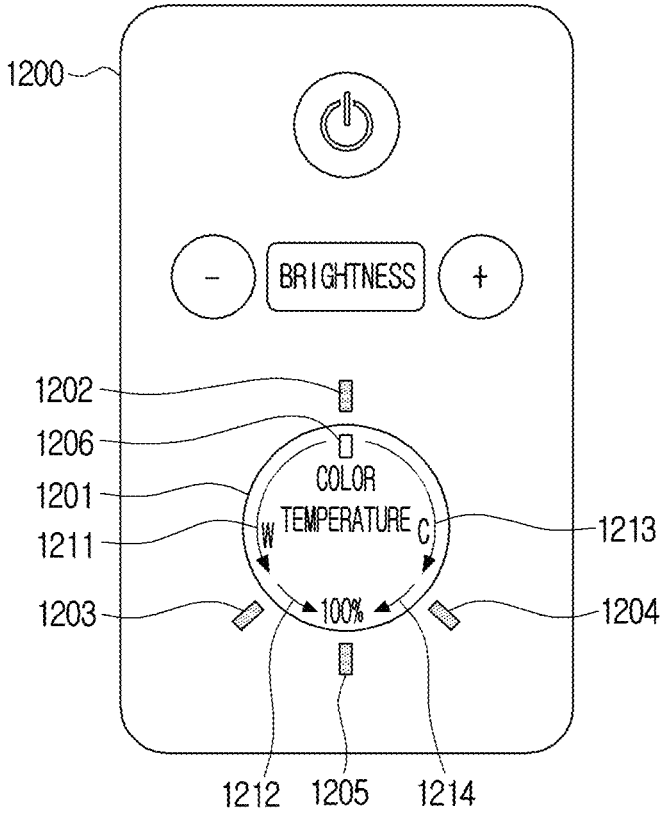
FIG. 12 is a diagram illustrating a remote control device communicating with a lighting device according to another embodiment.

Meanwhile, the second user input for adjusting the color temperature may be a control signal corresponding to an action in which a button 804 or a button 805 of FIG. 8 is selected, or a control signal corresponding to an action in which a dial 1201 of FIG. 12 is rotated.

The processor 140 may receive at least one of the first user input or the second user input via the communication interface 130.

According to an embodiment, the first user input and the second user input may be received together. Herein, the processor 140 may control the light emitting element by considering both the first user input and the second user input.

However, according to an implementation example, only any one of user input from among the first user input and the second user input may be received. In other words, the user input may include a control command regarding only any one of the brightness or the color temperature. Herein, with respect to an item for which the input is not received, the processor 140 may control the light emitting element with a recently provided numerical value. For example, if the user input regarding only the color temperature is received, the processor 140 may adjust the color temperature corresponding to the user input and maintain the recently provided brightness for the entire brightness.

The brightness herein may be replaced with a term such as a luminance, dimming, or the like.

The processor 140 may obtain the brightness (brightness value) corresponding to the first user input and adjust both the brightness of the first light emitting element 111 and the brightness of the second light emitting element 112 based on the obtained brightness. Herein, the term "adjust" may be replaced with a term such as change, convert, modify, or the like. The brightness corresponding to the first user input may refer to the entire brightness of the lighting device 100.

The processor 140 may obtain the brightness ratio information of the first light emitting element 111 to the second light emitting element 112 based on the second user input. The second user input herein may be a command for adjusting the color temperature and may be a command for determining which light from among the warm type light and the cold type light is to be emitted with more weight. The brightness ratio information herein may refer to a ratio of a brightness of a light output from the first light emitting element 111 to a brightness of a light output from the second light emitting element 112. For example, assuming that maximum outputs of the first light emitting element 111 and the second light emitting element 112 are the same as each other as 100, if the output of the first light emitting element 111 is 10 and the output of the second light emitting element 112 is 40, the ratio information may be 1:4. This will be described later in detail with reference to FIG. 5.

The processor 140 may identify the brightness of the first light emitting element 111 and the brightness of the second light emitting element 112 based on the entire brightness corresponding to the first user input and the brightness ratio information. In addition, the processor 140 may supply a power to each light emitting element so as to emit light with the identified brightness of the first light emitting element 111 and brightness of the second light emitting element 112.

Meanwhile, the processor 140 may identify an entire supply current corresponding to the brightness of the lighting device 100 based on the first user input and supply the identified entire supply current to the first light emitting element 111 and the second light emitting element 112 based on the obtained ratio information.

The processor 140 may obtain the entire supply current corresponding to the obtained brightness. In addition, the processor 140 may supply a current by distributing the obtained entire supply current to the first light emitting element 111 and the second light emitting element 112. As the entire supply current increases, the entire brightness of the lighting device 100 may increase. Accordingly, the processor 140 may determine the entire supply current according to the entire brightness corresponding to the first user input.

For example, it is assumed that the entire supply current is 100 and the ratio information (brightness of the first light emitting element 111:brightness of the second light emitting element 112) is 1:4. The processor 140 may supply 20 to the first light emitting element 111 and supply 80 to the second light emitting element 112.

Meanwhile, the processor 140 may identify a first current supplied to the first light emitting element 111 and a second current supplied to the second light emitting element 112 based on the entire supply current and the ratio information, identify whether at least one of the entire supply current, the first current, or the second current is in a threshold range, and identify that the lighting device 100 is broken down, if it is identified that at least one of the entire supply current, the first current, or the second current is not in the threshold range.

The processor 140 may determine or measure a current supplied to each of the first light emitting element 111 and the second light emitting element 112. The processor 140 may obtain the entire supply current, the first current (current supplied to the first light emitting element 111), and the second current (current supplied to the second light emitting element 112). The processor 140 may determine that the current is in a normal range. If the current is not in the normal range, the processor 140 may identify that the lighting device 100 is broken down. If the current is lower than a first threshold value or higher than a second threshold value, the processor 140 may identify that the lighting device 100 has a problem.

According to an implementation example, the threshold ranges of the entire supply current, the first current, and the second current may be different from each other. The threshold range for determining the normal range may be different based on an element or a circuit to which the current is supplied.

Meanwhile, the breakdown identification operation will be described later in detail with reference to FIG. 11.

Meanwhile, the processor 140 may obtain a first control signal corresponding to a first color temperature based on the entire supply current and the ratio information, obtain a second control signal corresponding to a second color temperature by inverting a waveform of the identified first control signal, transmit the first control signal to the first light emitting element 111, and transmit the second control signal to the second light emitting element 112.

The first control signal corresponding to the first color temperature may include information related to the brightness of the first light emitting element 111. In addition, the second control signal corresponding to the second color temperature may include information related to the brightness of the second light emitting element 112.

The processor 140 may obtain a waveform of the obtained first control signal and invert the obtained waveform to obtain the inverted first control signal. In addition, the processor 140 may determine the inverted first control signal as the second control signal. Herein, the processor 140 may obtain the second control signal by inverting the first control signal based on a predetermined function. The inversion method may be a method for inverting a sin waveform into a cos form or a method for converting a waveform of a signal using an inverting amplifier.

Meanwhile, the lighting device 100 may include a first switching element 121 and a second switching element 122, and the processor 140 may supply the first current to the first light emitting element 111 via the first switching element 121 based on the first control signal and supply the second current to the second light emitting element 112 via the second switching element 122 based on the second control signal.

Figure 7:
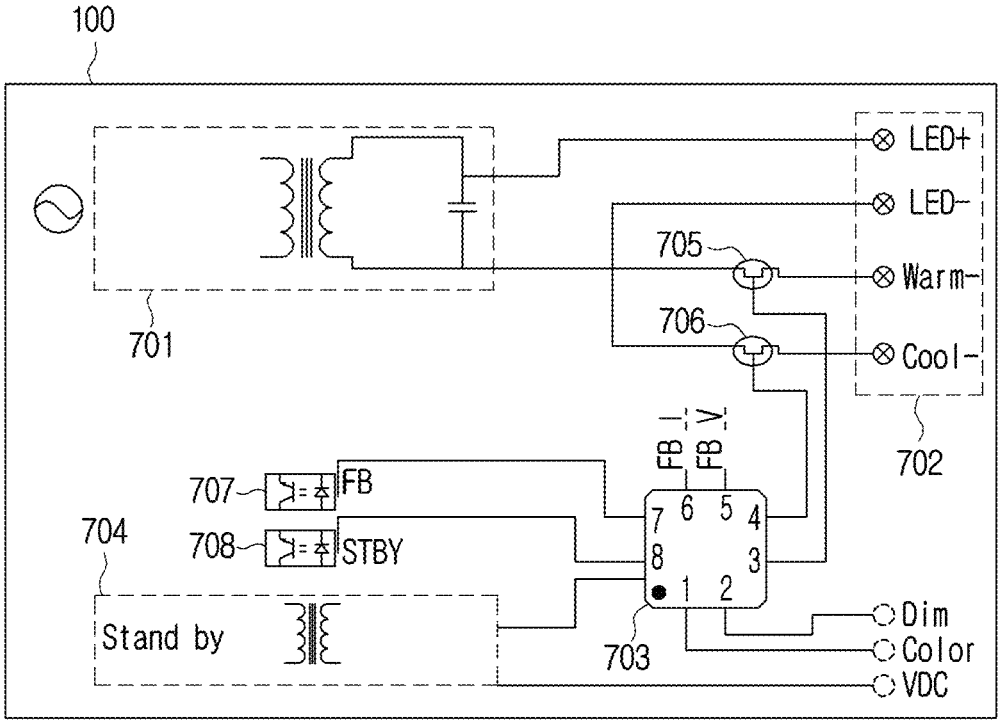
FIG. 7 is a diagram illustrating a circuit diagram configuring a lighting device according to an embodiment.

The first switching element 121 may correspond to a first switching element 705 of FIG. 7 and the second switching element 122 may correspond to a second switching element 706 of FIG. 7.

The processor 140 may divide the entire output current received from a power supply 150 into the first current and the second current by using the first switching element 121 and the second switching element 122. In addition, the processor 140 may control the power supply 150 and the switching elements 121 and 122 to supply the divided first current and second current to the first light emitting element 111 and the second light emitting element 112, respectively.

Specifically, the processor 140 may adjust the currents supplied to the first light emitting element 111 and the second light emitting element 112 by using the first switching element 121 and the second switching element 122.

Meanwhile, the lighting device 100 may further include an output terminal 170 including an LED positive electrode output terminal, an LED negative electrode output terminal, a first color temperature output terminal, and a second color temperature output terminal, the LED positive electrode output terminal may be connected to a positive electrode (anode) of the first light emitting element 111 and a positive electrode (anode) of the second light emitting element 112, the first color temperature output terminal may be connected to a negative electrode (cathode) of the first light emitting element 111, and the second color temperature output terminal may be connected to a negative electrode (cathode) of the second light emitting element 112. Meanwhile, in a case of controlling the brightness only with the first light emitting element, without the second light emitting element, the LED negative electrode output terminal may be connected to the negative electrode (cathode) of the first light emitting element.

In an embodiment of controlling a plurality of light emitting elements having color temperatures different from each other, the LED negative electrode output terminal may not be used. However, in an embodiment of controlling one light emitting element having one color temperature, the LED negative electrode output terminal may be connected to the negative electrode (cathode) of one light emitting element and the LED positive electrode output terminal may be connected to the positive electrode (anode) of one light emitting element.

This will be described later in detail with reference to FIG. 6.

Meanwhile, the lighting device 100 may further include a red light emitting diode, a green light emitting diode, and a blue light emitting diode, the output terminal 170 may further include a red output terminal, a green output terminal, and a blue output terminal, the LED positive electrode output terminal may be connected to a positive electrode (anode) of the red light emitting diode, a positive electrode (anode) of the green light emitting diode, and a positive electrode (anode) of the blue light emitting diode, the red output terminal may be connected to a negative electrode (cathode) of the red light emitting diode, the green output terminal may be connected to a negative electrode (cathode) of the green light emitting diode, and the blue output terminal may be connected to a negative electrode (cathode) of the blue light emitting diode.

In FIG. 1, only the first light emitting element 111 and the second light emitting element 112 are illustrated, but according to an implementation example, three elements of a red light emitting element R-LED, a green light emitting element G-LED, a blue light emitting element B-LED which emit colors different from each other may be included in a light emitting element module.

Meanwhile, the lighting device 100 may further include an auxiliary power supply 160, and if the power of the lighting device 100 is turned off, the processor 140 may supply the power to the lighting device 100 using the auxiliary power supply 160.

The lighting device 100 may be operated in a normal mode and a standby mode (power saving mode). The normal mode may refer to a state where light is emitted from a light emitting element. The standby mode may refer to a state where light is not emitted from a light emitting element and minimum power is consumed so that a power-on command is able to be received.

In the normal mode, the processor 140 may transfer the power supplied from the power supply 150 to the light emitting element.

In the standby mode, the processor 140 may cut the power supplied from the power supply 150 and use only the power supplied from the auxiliary power supply 160. Specifically, in the standby mode, the communication interface 130 may be maintained in an on state, in order to receive a user input (e.g., command for changing the power of the lighting device 100 to the on state).

Meanwhile, the processor 140 may identify the entire color temperature based on a light emitting operation to be finally output.

In an example, the processor 140 may identify the brightness of the first light emitting element 111 and the brightness of the second light emitting element 112, identify the entire color temperature, and provide the identified entire color temperature to the user. The processor 140 may provide the identified entire color temperature information to a terminal device of the user or a separate external device.

In another example, the lighting device 100 may include a camera and the processor 140 may measure the entire color temperature by capturing an image of the surrounding of the lighting device 100 using the camera.

Herein, the lighting device 100 may further include a display. The processor 140 may control the display to display the obtained entire color temperature or the ratio information. Specifically, the processor 140 may display the entire color temperature on the display. In addition, the processor 140 may display the ratio information of the brightness of the first light emitting element 111 to the brightness of the second light emitting element 112 on the display.

Meanwhile, the lighting device 100 according to an embodiment of the disclosure may adjust the color temperature by considering the ratio information of the brightness of the first light emitting element 111 to the brightness of the second light emitting element 112. By considering the ratio information, if the brightness of the first light emitting element 111 increases, the brightness of the second light emitting element 112 decreases, and therefore, the lighting device 100 may provide detailed and smooth color temperature adjustment to the user.

In addition, the lighting device 100 of the disclosure may provide high convenience to the user, since the color temperature is able to be consecutively changed based on the second user input.

Further, the lighting device 100 of the disclosure may minimize the entire power consumption, since only the standby power is supplied using the auxiliary power supply 160, when the light is not turned on.

Meanwhile, the lighting device 100 of the disclosure may control a normal light or an emotional light by one device. In addition, the lighting device 100 may reinforce an expression range, since the brightness or the color temperature is able to be controlled in detail from 0% to 100% with respect to the maximum output.

The lighting device 100 may simplify the circuit and save the cost by controlling both the brightness and the color temperature using one signal.

Meanwhile, hereinabove, the simple configuration configuring the lighting device 100 has been illustrated and described, but in the implementation, various configurations may be additionally provided. This will be described below with reference to FIG. 2.

Figure 2:
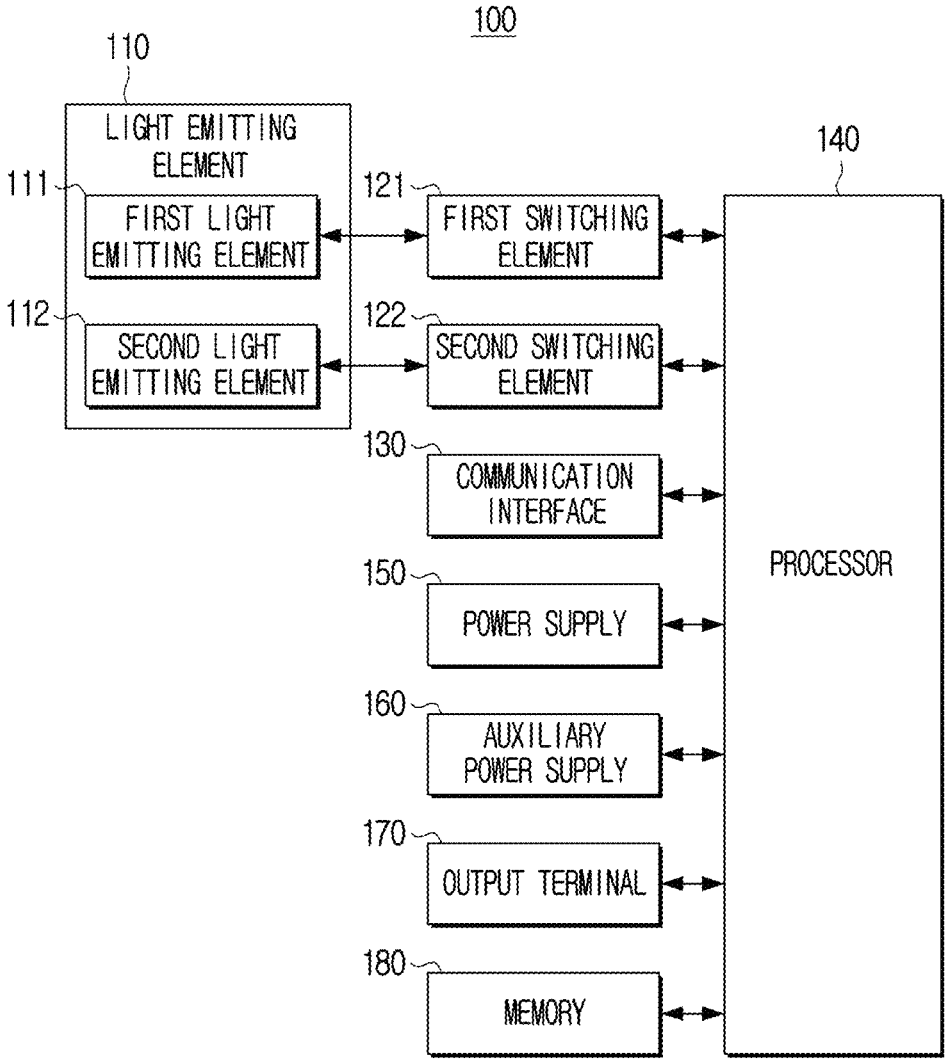
FIG. 2 is a block diagram illustrating a specific configuration of the lighting device of FIG. 1.

FIG. 2 is a block diagram illustrating a specific configuration of the lighting device of FIG. 1.

Referring to FIG. 2, the lighting device 100 may be configured with a light emitting element 110, the first switching element 121, the second switching element 122, the communication interface 130, the processor 140, the power supply 150, the auxiliary power supply 160, the output terminal 170, and a memory 180.

Meanwhile, the operations of the first light emitting element 111, the second light emitting element 112, the communication interface 130, and the processor 140 which are the same as those described above will not be repeated.

The light emitting element 110 may include the first light emitting element 111 and the second light emitting element 112. Herein, the light emitting element 110 may include a plurality of light emitting elements having color temperatures different from each other. For example, the light emitting element 110 may include at least one first light emitting element 111 having the first color temperature and at least one second light emitting element 112 having the second color temperature. Herein, the light emitting element 110 may refer to a light emitting element module.

The first switching element 121 and the second switching element 122 may be implemented as a mechanical switch or an electrical switch. Herein, the first switching element 121 and the second switching element 122 may refer to a transistor switch. In addition, the first switching element 121 and the second switching element 122 may be disposed so as to connect the processor 140 and the light emitting element 110 to each other.

The power supply 150 may supply the power to the processor 140 and the light emitting element 110. Herein, the power supply 150 may supply the power so that the power of the light emitting element 110 is turned on. The power supply 150 may supply the power with an output current or an output voltage.

The auxiliary power supply 160 may supply the power to the processor 140, when the power of the light emitting element 110 is turned off. When the power of the light emitting element 110 is turned off, it is necessary to prepare to receive a user command for turning on the power of the light emitting element 110 and the lighting device 100 may need the power for performing some functions. Herein, in a state where the power of the light emitting element 110 is turned off and the power supplied to the power supply 150 is cut, the auxiliary power supply 160 may supply auxiliary power to the communication interface 130 or the processor 140.

The output terminal 170 may include at least one output terminal. Specifically, the output terminal 170 may include at least one of the LED positive electrode output terminal, the LED negative electrode output terminal, the first color temperature output terminal, and the second color temperature output terminal.

The memory 180 may be implemented as an internal memory such as a ROM (e.g., electrically erasable programmable read-only memory (EEPROM)), a RAM, or the like included in the processor 140 or may be implemented as a memory separated from the processor 140. In this case, the memory 180 may be implemented in a form of a memory embedded in the lighting device 100 or implemented in a form of a memory detachable from the lighting device 100 according to data storage purpose. For example, data for operating the lighting device 100 may be stored in a memory embedded in the lighting device 100, and data for an extended function of the lighting device 100 may be stored in a memory detachable from the lighting device 100.

Figure 3:
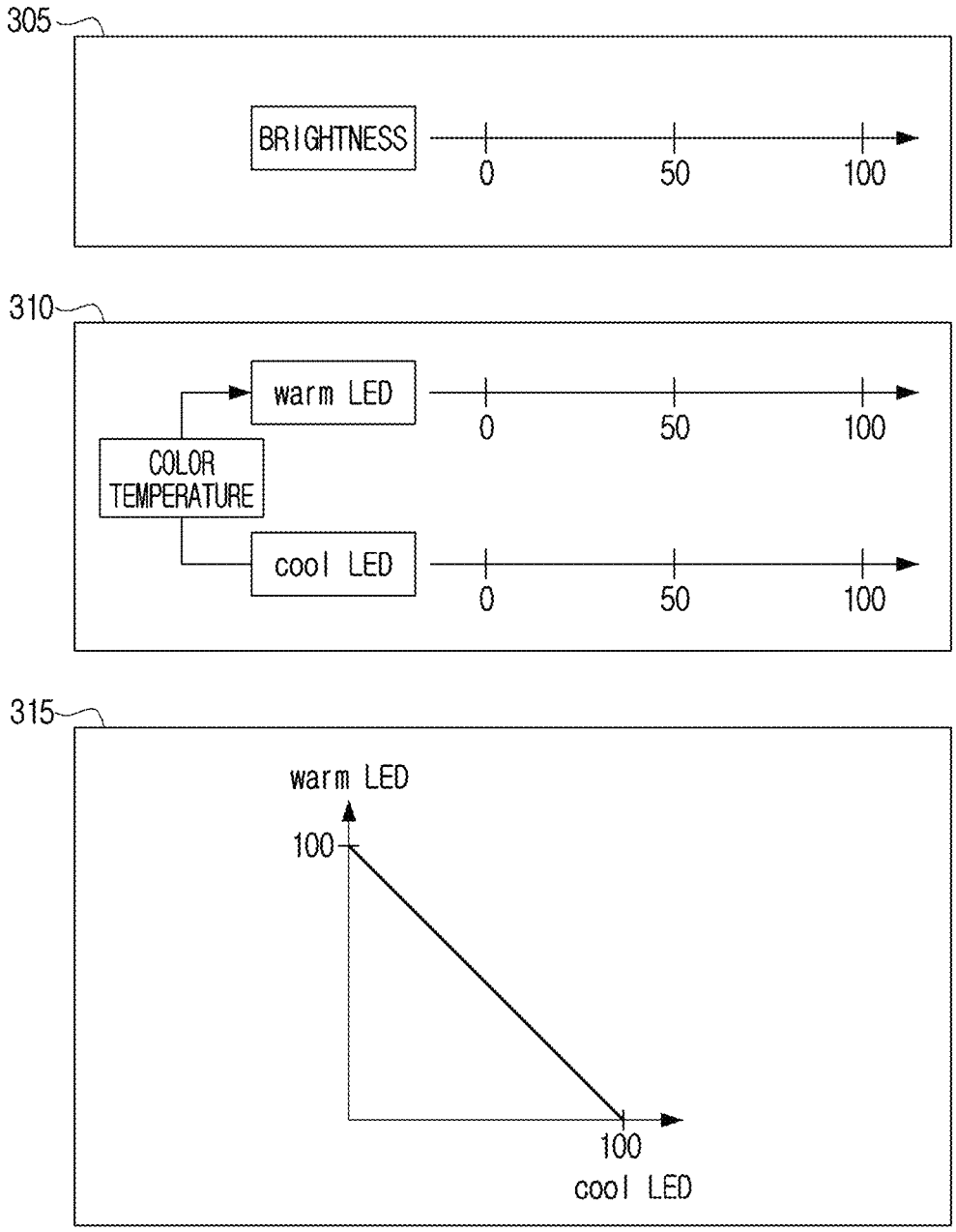
FIG. 3 is a diagram illustrating a relationship between a brightness of a first light emitting element and a brightness of a second light emitting element.

FIG. 3 is a diagram illustrating a relationship between a brightness of a first light emitting element and a brightness of a second light emitting element.

Referring to FIG. 3, according to an embodiment 305, the brightness of the lighting device 100 may be adjusted from 0 to 100. Herein, a maximum value of the brightness may vary depending on the type of the lighting device and thus may be a relative value. For example, the brightness value may be adjusted from 0% to 100%.

According to another embodiment 310, the lighting device 100 may include a plurality of light emitting elements, rather than one light emitting element. Herein, the lighting device 100 may include the first light emitting element 111 and the second light emitting element 112. The first light emitting element 111 may refer to a first type light emitting element having a first color temperature, and the first color temperature may refer to a warm tone and refer to a color having a kelvin value between 2,500 K and 3,500 K. The second color temperature may refer to a cold tone and refer to a color having a kelvin value between 5,500 K and 6,500 K. Herein, each of the first light emitting element 111 and the second light emitting element 112 may output the brightness from 0 to 100.

According to still another embodiment 315, the first light emitting element 111 and the second light emitting element 112 may individually determine the brightness of each light emitting element based on the ratio information of the brightness of the first light emitting element 111 to the brightness of the second light emitting element 112. Specifically, the lighting device 100 may control a total value of the brightness of the first light emitting element 111 and the brightness of the second light emitting element 112 to be constant. For example, if the brightness of the first light emitting element 111 is maximum, the lighting device 100 may adjust the brightness of the second light emitting element 112 to a minimum. In addition, if the brightness of the first light emitting element 111 is minimum, the lighting device 100 may adjust the brightness of the second light emitting element 112 to a maximum. Accordingly, if the brightness of the first light emitting element 111 is adjusted, the lighting device 100 may also adjust the brightness of the second light emitting element 112.

FIG. 4 is a table for describing a relationship between a brightness of a first light emitting element and a brightness of a second light emitting element, in a case where the entire brightness is constant.

Referring to a tale 405 of FIG. 4, the brightness of the lighting device 100 is assumed as 100. The lighting device 100 may control the first light emitting element 111 and the second light emitting element 112 so that the total value of the brightness of the first light emitting element 111 and the brightness of the second light emitting element 112 is 100.

Herein, the brightness may refer to an output current supplied from the lighting device 100. Accordingly, if the output current corresponding to the brightness of 100 is supplied to the entire light emitting element, the lighting device 100 may control the total value of the brightness of the first light emitting element 111 and the brightness of the second light emitting element 112 to be 100.

In an example, when the brightness of the first light emitting element 111 is 0, the lighting device 100 may adjust the brightness of the second light emitting element 112 to 100. In another example, if the brightness of the first light emitting element 111 is 25, the lighting device 100 may adjust the brightness of the second light emitting element 112 to 75. In still another example, if the brightness of the first light emitting element 111 is 50, the lighting device 100 may adjust the brightness of the second light emitting element 112 to 50. In still another example, if the brightness of the first light emitting element 111 is 75, the lighting device 100 may adjust the brightness of the second light emitting element 112 to 25. In still another example, if the brightness of the first light emitting element 111 is 100, the lighting device 100 may adjust the brightness of the second light emitting element 112 to 0.

FIG. 5 is a table for describing a relationship between a brightness of a first light emitting element and a brightness of a second light emitting element, in a case where the entire brightness is different.

Referring to a table 505 of FIG. 5, it is assumed that the ratio of the brightness of the first light emitting element 111 and the brightness of the second light emitting element 112 is set as 1:4. In an example, if the entire brightness is 0, the lighting device 100 may adjust both the brightness of the first light emitting element 111 and the brightness of the second light emitting element 112 to 0. In another example, if the entire brightness is 50, the lighting device 100 may adjust the brightness of the first light emitting element 111 to 10 and the brightness of the second light emitting element 112 to 40. In still another example, if the entire brightness is 100, the lighting device 100 may adjust the brightness of the first light emitting element 111 to 20 and the brightness of the second light emitting element 112 to 80.

Referring to a table 510, it is assumed that the ratio of the brightness of the first light emitting element 111 and the brightness of the second light emitting element 112 is set as 1:1. In an example, if the entire brightness is 0, the lighting device 100 may adjust both the brightness of the first light emitting element 111 and the brightness of the second light emitting element 112 to 0. In another example, if the entire brightness is 50, the lighting device 100 may adjust the brightness of the first light emitting element 111 to 25 and the brightness of the second light emitting element 112 to 25. In still another example, if the entire brightness is 100, the lighting device 100 may adjust the brightness of the first light emitting element 111 to 50 and the brightness of the second light emitting element 112 to 50.

Referring to a table 515, it is assumed that the ratio of the brightness of the first light emitting element 111 and the brightness of the second light emitting element 112 is set as 4:1. In an example, if the entire brightness is 0, the lighting device 100 may adjust both the brightness of the first light emitting element 111 and the brightness of the second light emitting element 112 to 0. In another example, if the entire brightness is 50, the lighting device 100 may adjust the brightness of the first light emitting element 111 to 40 and the brightness of the second light emitting element 112 to 10. In still another example, if the entire brightness is 100, the lighting device 100 may adjust the brightness of the first light emitting element 111 to 80 and the brightness of the second light emitting element 112 to 20.

Even when the ratio of the brightness of the first light emitting element 111 and the brightness of the second light emitting element 112 is already determined, if the entire brightness is adjusted, the brightness of the first light emitting element 111 and the brightness of the second light emitting element 112 may also be adjusted. In other words, if the entire brightness increases, the brightness of each light emitting element may also increase. Herein, the lighting device 100 may maintain the brightness ratio of the light emitting element according to an increase in entire brightness.

Figure 6:
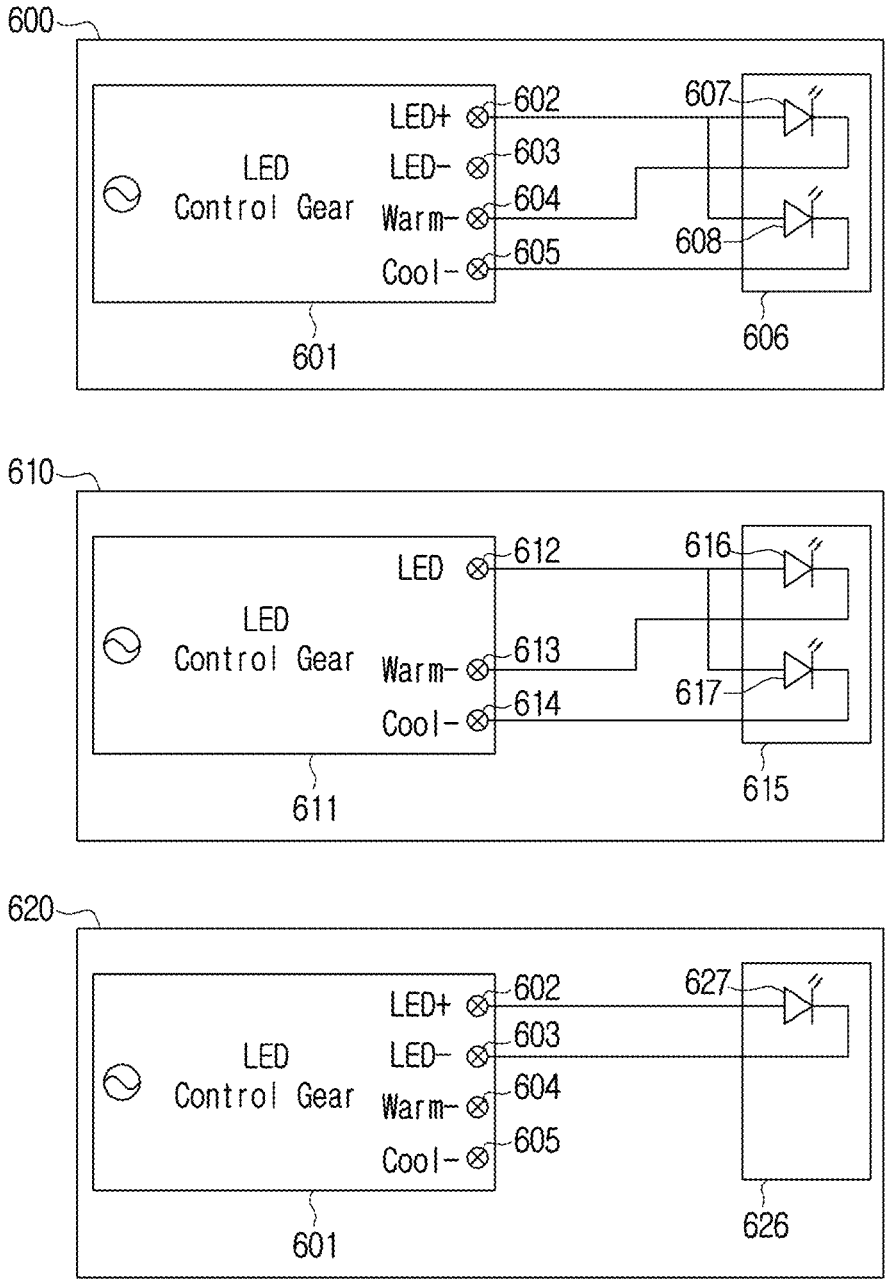
FIG. 6 is a diagram illustrating various embodiments in which a first light emitting element and a second light emitting element are connected to a light emitting control module.

FIG. 6 is a diagram illustrating various embodiments in which a first light emitting element and a second light emitting element are connected to a light emitting control module.

Referring to an embodiment 600 of FIG. 6, the lighting device 100 may include an LED control gear 601 and a light emitting element module 606.

Herein, the LED control gear 601 may refer to a main board for controlling a light emitting element module 606. The LED control gear 601 may include the switching elements 121 and 122, the communication interface 130, the processor 140, the power supply 150, the auxiliary power supply 160, and the output terminal 170 illustrated in FIG. 2. Herein, the output terminal 170 may include an LED positive electrode output terminal 602, an LED negative electrode output terminal 603, a first color temperature output terminal 604, and a second color temperature output terminal 605.

Herein, the light emitting element module 606 may include a first light emitting element 607 having the first color temperature and a second light emitting element 608 having the second color temperature. Herein, the LED positive electrode output terminal 602 may be connected to a positive electrode (anode) of the first light emitting element 607 and a positive electrode (anode) of the second light emitting element 608. Herein, the LED negative electrode output terminal 603 may not be connected to a separate light emitting element. The LED negative electrode output terminal 603 may be used, if a normal light which does not adjust the color temperature is connected. This will be described later in a still another embodiment 620. Herein, the first color temperature output terminal 604 may be connected to a negative electrode (cathode) of the first light emitting element 607. The second color temperature output terminal 605 may be connected to a negative electrode (cathode) of the second light emitting element 608.

In another embodiment 610, the lighting device 100 may include an LED control gear 611 and a light emitting element module 615, in the same manner as in the embodiment 600.

The LED control gear 611 may refer to a main board for controlling the light emitting element module 615. The LED control gear 611 may include the switching elements 121 and 122, the communication interface 130, the processor 140, the power supply 150, the auxiliary power supply 160, and the output terminal 170 illustrated in FIG. 2. Herein, the output terminal 170 may include an LED positive electrode output terminal 612, a first color temperature output terminal 613, and a second color temperature output terminal 614.

Herein, the light emitting element module 615 may include a first light emitting element 616 having the first color temperature and a second light emitting element 617 having the second color temperature. Herein, the LED positive electrode output terminal 612 may be connected to a positive electrode (anode) of the first light emitting element 616 and a positive electrode (anode) of the second light emitting element 617. Herein, the first color temperature output terminal 613 may be connected to a negative electrode (cathode) of the first light emitting element 616. The second color temperature output terminal 614 may be connected to a negative electrode (cathode) of the second light emitting element 617.

The LED control gear 611 according to the other embodiment 610 may be used only for an emotional light, since it does not include the LED negative electrode output terminal 603. The LED control gear 601 commonly usable for a normal light and an emotional light has an advantage of high user convenience, and the LED control gear 611 usable only for an emotional light has an advantage of low breakdown rate and product production cost.

If one standardized LED control gear is used, the normal light and the emotional light may be controlled. In addition, if a current variable function in the LED control gear is used, the LED control gear may be used in products with various brightness.

The LED control gear is configured with semiconductor components and may be implemented as a structure capable of receiving a feedback of a voltage or a current. In addition, the LED control gear may supply an output current set based on a brightness signal received from outside (fixed output current or variable current using software/external resistance or the like) to the light emitting element. In addition, the LED control gear may determine the color temperature by adjusting the ratio of the output current based on the switching element. Herein, if a total of the output current is 100%, the LED control gear may distribute the current to each of the light emitting elements.

The LED control gear 601 according to the embodiment 600 may be used for both the normal light (light including light emitting elements having one color temperature) and the emotional light (light including a plurality of light emitting elements having color temperatures different from each other).

Referring to still another embodiment 620, the lighting device 100 may include the LED control gear 601 and a light emitting element module 626.

Herein, the light emitting element module 626 may include the normal light. The normal light herein may refer to a lamp having one color temperature. The lighting device 100 may control the light emitting element module 626 including the light emitting element having one color temperature by using the LED control gear 601 which is the same as in the one embodiment 600, in addition to the light emitting element module 606 including the plurality of light emitting elements having color temperatures different from each other.

Herein, the light emitting element module 626 may include only a first light emitting element 627 having the first color temperature. Herein, the LED positive electrode output terminal 602 may be connected to a positive electrode (anode) of the first light emitting element 627 and the LED negative electrode output terminal 603 may be connected to a negative electrode (cathode) of the first light emitting element 627.

Based on the one embodiment 600 and the other embodiment 620, the lighting device 100 may use the same LED control gear 601 not only in the light emitting element module capable of expressing the plurality of color temperatures, but also in a light emitting element module capable of expressing one color temperature, in the same manner Therefore, the lighting device 100 may have high compatibility, since it is used in various light emitting element modules.

FIG. 7 is a diagram illustrating a circuit diagram configuring a lighting device according to an embodiment.

Referring to FIG. 7, the lighting device 100 may include a power supply 701, an output terminal 702, a processor 703, an auxiliary power supply 704, a first switching element 705, a second switching element 706, and switches 707 and 708.

Herein, the power supply 701, the output terminal 702, the processor 703, the auxiliary power supply 704, the first switching element 705, and the second switching element 706 may correspond to each element of FIG. 2.

Herein, the output terminal 702 may include an LED positive electrode output terminal, an LED negative electrode output terminal, a first color temperature output terminal, and a second color temperature output terminal.

The power supply 701 may be connected to all of the LED positive electrode output terminal, the LED negative electrode output terminal, the first color temperature output terminal, and the second color temperature output terminal included in the output terminal 702. Herein, the first switching element 705 may be disposed between the power supply 701 and the first color temperature output terminal, and the second switching element 706 may be disposed between the power supply 701 and the second color temperature output terminal.

In addition, the power supply 701 may be connected to the processor 703. Herein, the second switching element 706 may be connected between the power supply 701 and the processor 703. In other words, the power supply 701 may supply the power to the processor 703 via the second switching element 706.

The auxiliary power supply 704 may be connected to the processor 703. Herein, the auxiliary power supply 704 may supply standby power to the processor 703, when the power of the light emitting element is turned off. When the power of the lighting device 100 is turned off, the lighting device 100 may receive only the standby power via the auxiliary power supply 704, in order to maintain a state capable of receiving a command for turning on the power of the lighting device 100. The state in which the power of the light emitting element is turned off may be a standby mode, and in the standby mode, the power supplied to the power supply 701 may be cut.

The processor 703 may receive a user input signal including at least one of a brightness adjustment command or a color temperature adjustment command and control the lighting device 100 so as to perform an operation corresponding to the received user input signal.

In addition, the lighting device 100 may include the switch 707 for supplying or cutting the power of the power supply 701 and the switch 708 for supplying or cutting the power of the auxiliary power supply 704.

Meanwhile, the lighting device 100 may independently control the brightness and the color temperature to increase efficiency of the emotional light (light capable of providing a plurality of color temperatures). The lighting device 100 may be implemented to use only the normal light (light in which the color temperature may not be adjusted), use only the emotional light, or use the normal light and the emotional light at the same time. In addition, the lighting device 100 may control both the first light emitting element 111 and the second light emitting element 112 based on the user input regarding one color temperature type.

The lighting device 100 may independently control a brightness control signal and a color temperature control signal. In addition, the lighting device 100 may adjust the brightness by controlling the output current based on a reference voltage or pulse. Further, the lighting device 100 may transmit the output current including the control signal regarding the brightness to a current distribution circuit. The current distribution circuit may adjust the received output current based on a ratio (ratio information) of the current applied to the first light emitting element 111 and the second light emitting element 112. The entire color temperature may become different according to the adjustment of the ratio of the current.

Meanwhile, the lighting device 100 may include a switching element for controlling a ratio of a current flowing to each light emitting element in order to control the light emitting element, a sensing product for receiving a feedback of a voltage or a current flowing to the light emitting element, a brightness/color temperature signal transfer unit for applying a reference signal necessary for control, a semiconductor for proceeding the control using various signals, and a feedback control unit for controlling a result of a processed signal.

Meanwhile, the lighting device 100 may individually obtain each of the first current and the second current supplied to the first light emitting element 111 and the second light emitting element 112. In an example, the lighting device 100 may obtain the first current by multiplying the brightness ratio of the first light emitting element 111 by the entire supply current, obtain the second current by multiplying the brightness ratio of the second light emitting element 112 by the entire supply current, and supply the obtained first current and second current to the first light emitting element 111 and the second light emitting element 112.

In another example, the lighting device 100 may obtain the first current by multiplying the brightness ratio of the first light emitting element 111 by the entire supply current, obtain the second current by inverting a signal corresponding to the first current, and supply the obtained first current and second current to the first light emitting element 111 and the second light emitting element 112.

Meanwhile, even in the embodiment of using only the normal light, which is different from the implementation method according to a connection method of the normal light and the emotional light, the normal light may be used in the connection structure of the emotional light through a change of the switching signal, and the applied current may be controlled to maximize the usage effect of the normal light. In addition, the lighting device 100 may control the color temperature through inversion of the switching unit by using an external communication module signal.

FIG. 8 is a diagram illustrating a remote control device communicating with a lighting device according to an embodiment.

Referring to FIG. 8, the lighting device 100 may receive a user input from a remote control device 800. The remote control device 800 may include a button 801 for turning on/off the power of the lighting device 100, buttons 802 and 803 for adjusting the brightness, and buttons 804 and 805 for adjusting the color temperature.

Herein, the button for adjusting the color temperature may include the button 804 for decreasing the color temperature and the button 805 for increasing the color temperature. As an amount of warm type light increases, the color temperature may be decreased, and as an amount of cold type light increases, the color temperature may be increased.

According to an implementation example, in the lighting device 100, buttons for increasing and decreasing brightness of each color temperature may be separately disposed. However, since the lighting device 100 according to an embodiment of the disclosure adjusts the first color temperature and the second temperature at the same time, the color temperature may be adjusted only by the button 804 for decreasing the color temperature and the button 805 for increasing the color temperature.

If a user input of pressing the button 804 for decreasing the color temperature is repeatedly received, the lighting device 100 may increase the brightness of the first light emitting element 111 and decrease the brightness of the second light emitting element 112, each time when the user input is received. For example, the embodiment according to the user input may be changed from case 1 to case 5 included in the table 405 of FIG. 4.

In addition, if a user input of pressing the button 805 for increasing the color temperature is repeatedly received, the lighting device 100 may decrease the brightness of the first light emitting element 111 and increase the brightness of the second light emitting element 112, each time when the user input is received. For example, the embodiment according to the user input may be changed from case 5 to case 1 included in the table 405 of FIG. 4.

Meanwhile, in describing FIG. 8, it is described that a command corresponding to each function is input via the buttons, but a remote control device including a display may receive a user input by a touch input method, rather than the button.

Figure 9:
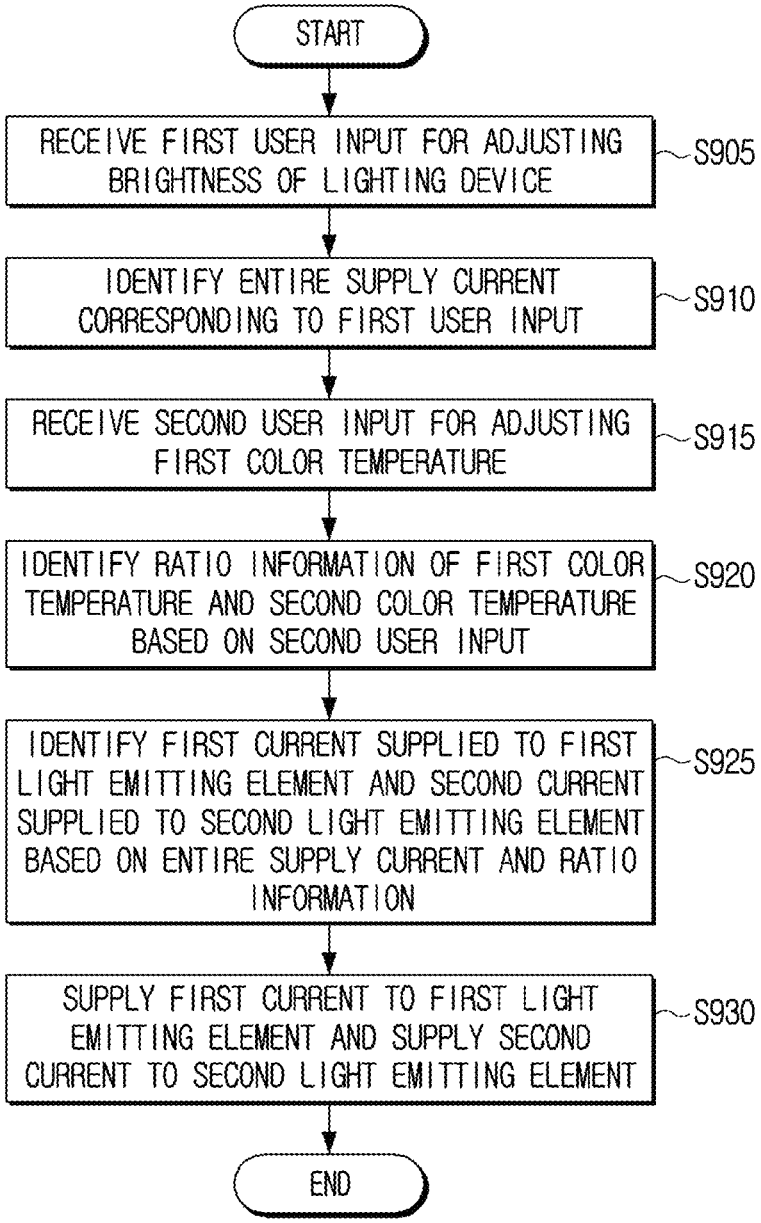
FIG. 9 is a flowchart illustrating a method for determining a current supplied to a first light emitting element and a second light emitting element.

FIG. 9 is a flowchart illustrating a method for determining a current supplied to a first light emitting element and a second light emitting element.

Referring to FIG. 9, the lighting device 100 may receive a first user input for adjusting the brightness of the lighting device 100 (S905). In addition, the lighting device 100 may identify the entire supply current corresponding to the first user input (S910). The first user input herein may be a user command for selecting the entire brightness information of the lighting device 100. Accordingly, the lighting device 100 may identify the entire supply current (or entire supply voltage) for supplying the brightness corresponding to the user input.

In addition, the lighting device 100 may receive a second user input for adjusting the color temperature (S915). For example, the second user input may be a user command for selecting how to control the color temperature of the lighting device 100.

In addition, the lighting device 100 may identify ratio information of the brightness of the first light emitting element 111 to the brightness of the second light emitting element 112 based on the second user input (S920). For example, the ratio of the brightness of the first light emitting element 111 to the brightness of the second light emitting element 112 may be 1:4, 1:1, and 4:1. The above ratios are merely an embodiment and may be changed according to the user setting.

In addition, the lighting device 100 may identify the first current supplied to the first light emitting element 111 and the second current supplied to the second light emitting element 112 based on the entire supply current and the ratio information (S925). The lighting device 100 may obtain the ratio of the brightness of the first light emitting element 111 with respect to the entire brightness and obtain the first current (first current value) by multiplying the ratio by the entire supply current.

For example, it is assumed that the entire supply current is 100 and the ratio of the brightness of the first light emitting element 111 to the brightness of the second light emitting element 112 is 1:4. The lighting device 100 may identify that the ratio of the brightness of the first light emitting element 111 to the brightness of the second light emitting element 112 is 1:4. Accordingly, the ratio of the brightness of the first light emitting element 111 may be calculated as 0.25 and the ratio of the brightness of the second light emitting element 112 may be calculated as 0.75. In addition, the lighting device 100 may obtain the first current and the second current (second current value) by multiplying each ratio by the entire supply current. The first current may be 25 (=100*0.25) and the second current may be 75 (=100*0.75).

The lighting device 100 may control the power supply 150 and the switching elements 121 and 122 so as to supply the first current to the first light emitting element 111 and supply the second current to the second light emitting element 112 (S930). Specifically, the lighting device 100 may control the power supply 150 and the first switching element 121 in order to supply the first current to the first light emitting element 111. In addition, the lighting device 100 may control the power supply 150 and the second switching element 122 in order to supply the second current to the second light emitting element 112.

Figure 10:
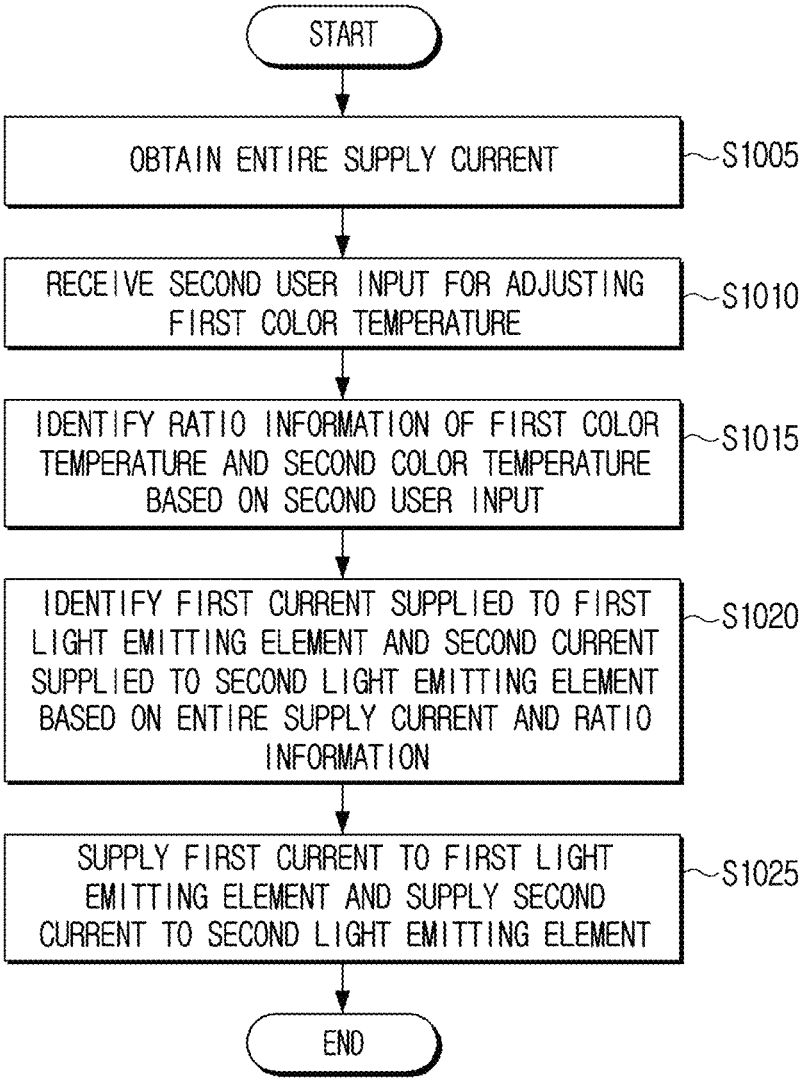
FIG. 10 is a flowchart illustrating an operation of a lighting device, when a user input for adjusting a color temperature is received.

FIG. 10 is a flowchart illustrating an operation of a lighting device, when a user input for adjusting a color temperature is received.

Referring to FIG. 10, the lighting device 100 may obtain the entire supply current (entire supply current value) (S1005). The entire supply current herein may refer to a predetermined current. In a situation in which the entire brightness of the lighting device 100 is determined in advance, the entire supply current may also be determined in advance. For example, if the user turns light on, a brightness immediately before that may be stored in the memory. In addition, if the light is already turned on, the lighting device 100 may obtain the constantly supplied entire supply current.

In addition, the lighting device 100 may receive the second user input for adjusting the color temperature (S1010). For example, the second user input may be a user command for selecting how to control the color temperature of the lighting device 100.

The lighting device 100 may identify ratio information of the brightness of the first light emitting element 111 to the brightness of the second light emitting element 112 based on the second user input (S1015). For example, the ratio of the brightness of the first light emitting element 111 to the brightness of the second light emitting element 112 may be 1:4, 1:1, and 4:1. The above ratios are merely an embodiment and may be changed according to the user setting.

In addition, the lighting device 100 may identify the first current supplied to the first light emitting element 111 and the second current supplied to the second light emitting element 112 based on the entire supply current and the ratio information (S1020). The lighting device 100 may obtain the ratio of the brightness of the first light emitting element 111 with respect to the entire brightness and obtain the first current (first current value) by multiplying the ratio by the entire supply current.

The lighting device 100 may control the power supply 150 and the switching elements 121 and 122 so as to supply the first current to the first light emitting element 111 and supply the second current to the second light emitting element 112 (S1025). Specifically, the lighting device 100 may control the power supply 150 and the first switching element 121 in order to supply the first current to the first light emitting element 111. In addition, the lighting device 100 may control the power supply 150 and the second switching element 122 in order to supply the second current to the second light emitting element 112.

Figure 11:
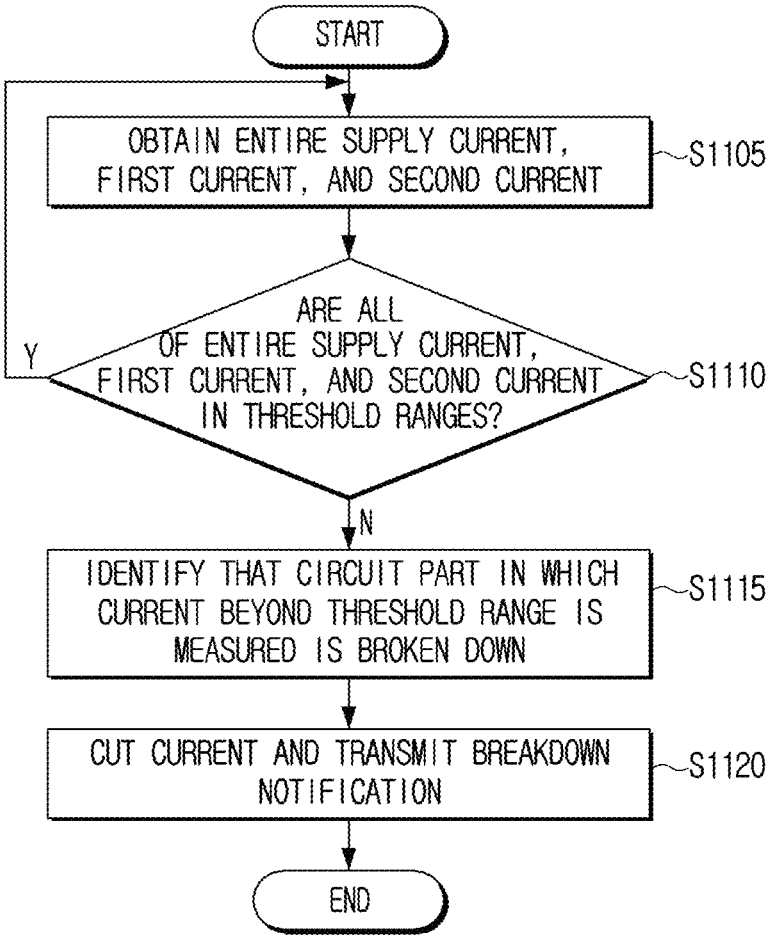
FIG. 11 is a flowchart illustrating an operation of determining a breakdown of a lighting device.

FIG. 11 is a flowchart illustrating an operation of determining a breakdown of a lighting device.

Referring to FIG. 11, the lighting device 100 may obtain the entire supply current, the first current, and the second current (S1105).

In addition, the lighting device 100 may identify whether at least one current of the entire supply current, the first current, and the second current is beyond a threshold range (S1110). Specifically, the lighting device 100 may monitor whether each current is maintained at an appropriate level. When the lighting device 100 is operated normally, each current may have a value in a certain range. Accordingly, the lighting device 100 may determine whether one current of the currents is beyond the threshold range.

According to an implementation example, the threshold range may be different for each current. For example, the lighting device 100 may determine whether the first current is beyond a first threshold range, determine whether the second current is beyond a second threshold range, and determine whether the entire supply current is beyond a third threshold range.

If all of the entire supply current, the first current, and the second current are in the threshold ranges (S1110—Y), the lighting device 100 may continuously obtain the entire supply current, the first current, and the second current and determine whether these are beyond the threshold ranges.

If all of the entire supply current, the first current, and the second current are beyond the threshold ranges (S1110-N), the lighting device 100 may identify that a circuit part where the current beyond the threshold range is measured is broken down (S1115). The circuit part herein may refer to specific hardware or a specific circuit. Herein, the operation of determining that all of the entire supply current, the first current, and the second current are beyond the threshold ranges may refer to an operation of determining that at least one current from among all of the entire supply current, the first current, and the second current is beyond the threshold range.

If it is identified that a specific circuit part is broken down, the lighting device 100 may cut the current and generate and provide a breakdown notification message to a user (S1120). Herein, the lighting device 100 may transmit the breakdown notification message to a user terminal device.

According to an embodiment, the lighting device 100 may cut the entire supply power. Herein, since all currents supplied to the first light emitting element 111 and the second light emitting element 112 are cut, the brightness of the first light emitting element 111 and the brightness of the second light emitting element 112 may become 0.

According to another embodiment, the lighting device 100 may selectively cut only the current supplied to the specific circuit part. For example, if only the first current supplied to the first light emitting element 111 is beyond the threshold range, the lighting device 100 may cut only the first current and supply the second current continuously with the same current value.

FIG. 12 is a diagram illustrating a remote control device communicating with a lighting device according to another embodiment.

Referring to FIG. 12, a remote control device 1200 communicating with the lighting device 100 may include a color temperature adjustment dial 1201. Herein, the dial 1201 may include a first mark 1202, a second mark 1203, a third mark 1204, a fourth mark 1205, and a reference mark 1206.

Herein, the first mark 1202 may be displayed on an upper side of the dial 1201, the second mark 1203 may be displayed on a lower left side of the dial 1201, the third mark 1204 may be displayed on a lower right side of the dial 1201, and the fourth mark 1205 may be displayed on a lower side of the dial 1201.

The reference mark 1206 may be displayed on a surface of the dial 1201. The reference mark 1206 may notify the user where the dial is currently rotated. If the user rotates the dial 1201, the reference mark 1206 may move according to the movement of the dial 1201.

If a user input 1211 for moving the reference mark 1206 from a position of the first mark 1202 to a position of the second mark 1203 is received, the lighting device 100 may adjust the ratio of the brightness of the first light emitting element 111 to the brightness of the second light emitting element 112 from 1:1 to 100:0. The user input 1212 may refer to a user input for rotating the dial 1201 to the left. Specifically, the lighting device 100 may increase the brightness ratio of the first light emitting element 111 based on the user input 1211.

If a user input 1212 for moving the reference mark 1206 from the position of the second mark 1203 to a position of the fourth mark 1205 is received, the lighting device 100 may increase the entire brightness. If the reference mark 1206 is already at the second mark 1203, the ratio of the brightness of the first light emitting element 111 to the brightness of the second light emitting element 112 may be 100:0. In a situation in which the ratio of the brightness of the first light emitting element 111 to the brightness of the second light emitting element 112 is 100:0, the second light emitting element 112 may be in a state of being turned off. Accordingly, the lighting device 100 may increase the brightness of the first light emitting element 111 having the first color temperature based on the user input 1212. The lighting device 100 may increase the entire supply current in order to further increase the brightness of the first light emitting element 111. If the reference mark 1206 is positioned at the fourth mark 1205, the lighting device 100 may supply the maximum supply current to the first light emitting element 111.

Meanwhile, if a user input 1213 for moving the reference mark 1206 from the position of the first mark 1202 to the position of the third mark 1204 is received, the lighting device 100 may adjust the ratio of the brightness of the first light emitting element 111 to the brightness of the second light emitting element 112 from 1:1 to 0:100. In a situation in which the ratio of the brightness of the first light emitting element 111 to the brightness of the second light emitting element 112 is 0:100, the first light emitting element 111 may be in a state of being turned off. The user input 1213 may refer to a user input for rotating the dial 1201 to the right. Specifically, the lighting device 100 may increase the brightness ratio of the second light emitting element 112 based on the user input 1213.

If a user input 1214 for moving the reference mark 1206 from the position of the third mark 1204 to a position of the fourth mark 1205 is received, the lighting device 100 may increase the entire brightness. If the reference mark 1206 is already at the third mark 1204, the ratio of the brightness of the first light emitting element 111 to the brightness of the second light emitting element 112 may be 0:100. Accordingly, the lighting device 100 may increase the brightness of the second light emitting element 112 having the second color temperature based on the user input 1214. The lighting device 100 may increase the entire supply current in order to further increase the brightness of the second light emitting element 112. When the reference mark 1206 is positioned at the fourth mark 1205, the lighting device 100 may supply the maximum supply current to the second light emitting element 112.

Figure 13:
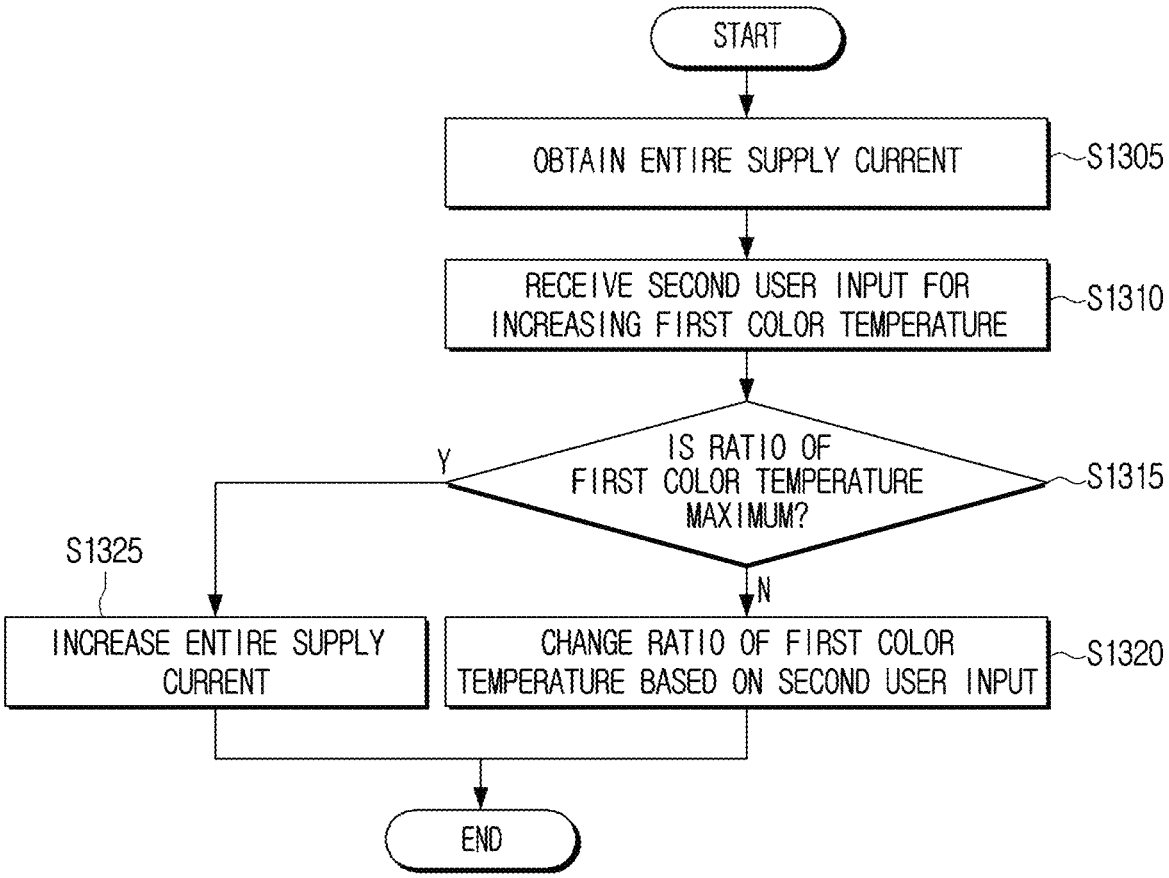
FIG. 13 is a flowchart illustrating an operation of a lighting device in an embodiment of FIG. 12.

FIG. 13 is a flowchart illustrating an operation of a lighting device in an embodiment of FIG. 12.

Referring to FIG. 13, the lighting device 100 may obtain the entire supply current (S1305). Specifically, the lighting device 100 may obtain a total current value supplied to the light emitting element. In addition, the lighting device 100 may receive the second user input for decreasing the color temperature (S1310).

The lighting device may identify whether the brightness ratio of the first light emitting element 111 is the maximum (S1315). If the brightness ratio of the first light emitting element 111 is not maximum (S1315—N), the lighting device 100 may change the brightness of the first light emitting element 111 based on the second user input (S1320). For example, if the ratio of the brightness of the first light emitting element 111 to the brightness of the second light emitting element 112 is not 100:0, the lighting device 100 may change the brightness ratio of the first light emitting element 111. In an example, the operation S1320 may be an operation corresponding to the user input 1211 of FIG. 12. Specifically, the lighting device 100 may adjust both the brightness of the first light emitting element 111 and the brightness of the second light emitting element 112, in order to change the ratio of the first light emitting element 111 to the brightness of the second light emitting element 112 from 1:1 to 100:0.

Meanwhile, if the brightness ratio of the first light emitting element 111 is the maximum (S1315—Y), the lighting device 100 may increase the entire supply current (S1325). For example, in a state in which the ratio of the brightness of the first light emitting element 111 to the brightness of the second light emitting element 112 is 100:0, the entire supply current may be increased to further increase the brightness of the first light emitting element 111. The second light emitting element 112 may be in a state of being turned off. The operation S1325 may be an operation corresponding to the user input 1212 of FIG. 12. The lighting device 100 may increase the entire supply current, in order to further increase the brightness of the first light emitting element 111, in a state in which the second light emitting element 112 is turned off.

Figure 14:
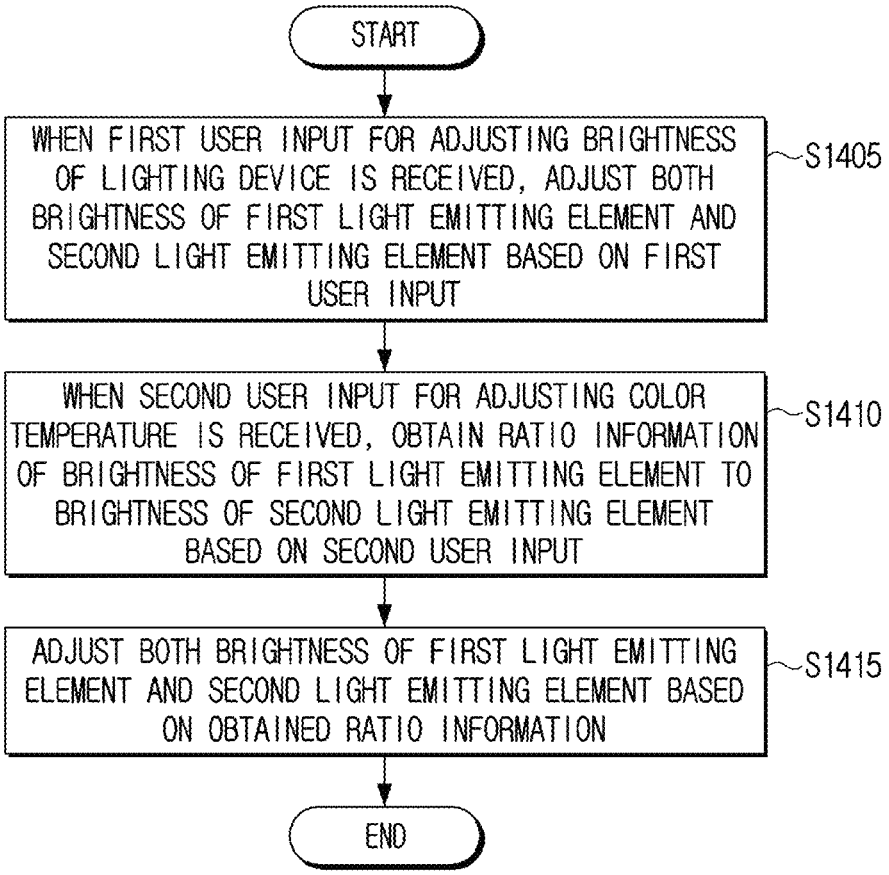
FIG. 14 is a flowchart illustrating a method for controlling a lighting device according to an embodiment.

FIG. 14 is a flowchart illustrating a method for controlling a lighting device according to an embodiment.

Referring to FIG. 14, a method for controlling the lighting device 100 according to an embodiment of the disclosure may include, when the first user input for adjusting the brightness of the lighting device 100 is received, adjusting both of brightness of the first light emitting element 111 having the first color temperature and the second light emitting element 112 having the second color temperature based on the first user input (S1405), when a second user input for adjusting the color temperature is received, obtaining ratio information of the brightness of the first light emitting element 111 to the brightness of the second light emitting element 112 based on the second user input (S1410), and adjusting both of the brightness of the first light emitting element 111 and the second light emitting element 112 based on the obtained ratio information (S1415).

The control method may further include, when the first user input for increasing the brightness of the lighting device 100 is received, controlling the brightness of the first light emitting element 111 and the second light emitting element 112 so as to increase both the brightness of the first light emitting element 111 and the brightness of the second light emitting element 112.

The control method may further include, when the second user input for decreasing the color temperature is received, controlling the brightness of the first light emitting element 111 and the second light emitting element 112 so as to increase the brightness of the first light emitting element 111 and decrease the brightness of the second light emitting element 112.

The control method may further include identifying the entire supply current corresponding to the brightness of the lighting device 100 based on the first user input, and supplying the identified entire supply current to the first light emitting element 111 and the second light emitting element 112 based on the obtained ratio information.

The control method may further include identifying the first current supplied to the first light emitting element 111 and the second current supplied to the second light emitting element 112 based on the entire supply current and the ratio information, identifying whether at least one of the entire supply current, the first current, or the second current is beyond a threshold range, and when at least one of the entire supply current, the first current, or the second current is identified to be beyond the threshold range, identifying that the lighting device 100 is broken down.

The control method may further include obtaining a first control signal corresponding to the first color temperature based on the entire supply current and the ratio information, obtaining a second control signal corresponding to the second color temperature by inverting a waveform of the identified first control signal, transmitting the first control signal to the first light emitting element 111, and transmitting the second control signal to the second light emitting element 112.

The control method may further include supplying the first current to the first light emitting element 111 via the first switching element 121 based on the first control signal, and supplying the second current to the second light emitting element 112 via the second switching element 122 based on the second control signal.

The control method may further include, when the power of the lighting device 100 is turned off, supplying the power to the lighting device 100 using the auxiliary power supply 160.

The method for controlling the lighting device of FIG. 14 may be executed on the lighting device having the configuration of FIG. 1 or FIG. 2, and may also be executed on a lighting device having other configurations.

The methods according to various embodiments of the disclosure described above may be implemented in a form of an application installable in the lighting device of the related art.

In addition, the methods according to various embodiments of the disclosure described above may be implemented simply by the software upgrade or hardware upgrade in the electronic device of the related art.

Further, the various embodiments of the disclosure described above may be performed through an embedded server provided in the lighting device or an external server of at least one of the lighting device or a display device.

According to an embodiment of the disclosure, the various embodiments described above may be implemented as software including instructions stored in machine (e.g., computer)-readable storage media. The machine is a device which invokes instructions stored in the storage medium and is operated according to the invoked instructions, and may include the lighting device according to the embodiments described above. In a case where the instruction is executed by a processor, the processor may perform a function corresponding to the instruction directly or using other elements under the control of the processor. The instruction may include a code made by a compiler or a code executable by an interpreter. The machine-readable storage medium may be provided in a form of a non-transitory storage medium. Here, the "non-transitory" storage medium is tangible and may not include signals, and it does not distinguish that data is semi-permanently or temporarily stored in the storage medium.

According to an embodiment of the disclosure, the methods according to various embodiments disclosed in this disclosure may be provided in a computer program product. The computer program product may be exchanged between a seller and a purchaser as a commercially available product. The computer program product may be distributed in the form of a machine-readable storage medium (e.g., compact disc read only memory (CD-ROM)) or distributed online through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

Each of the elements (e.g., a module or a program) according to various embodiments described above may include a single entity or a plurality of entities, and some sub-elements of the abovementioned sub-elements may be omitted or other sub-elements may be further included in various embodiments. Alternatively or additionally, some elements (e.g., modules or programs) may be integrated into one entity to perform the same or similar functions performed by each respective element prior to the integration. Operations performed by a module, a program, or other elements, in accordance with various embodiments, may be performed sequentially, in a parallel, repetitive, or heuristically manner, or at least some operations may be performed in a different order, omitted, or may add a different operation.

While preferred embodiments of the disclosure have been shown and described, the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. A lighting device comprising:

a first light emitting element having a first color temperature;

a second light emitting element having a second color temperature;

a third light emitting element having a third color temperature;

a communication interface;

a first switching element and a second switching element;

an output terminal comprising an LED positive electrode output terminal, an LED negative electrode output terminal, a first color temperature output terminal, and a second color temperature output terminal; and a processor;

wherein the LED positive electrode output terminal is connected to a positive electrode (anode) of the first light emitting element, a positive electrode (anode) of the second light emitting element and a positive electrode (anode) of the third light emitting element, wherein the first color temperature output terminal is connected to a negative electrode (cathode) of the first light emitting element, wherein the second color temperature output terminal is connected to a negative electrode (cathode) of the second light emitting element, wherein the LED negative electrode output terminal is connected to a negative electrode (cathode) of the third light emitting element, if the brightness is controlled only by the third light emitting element for a normal light, without the first light emitting element and the second light emitting element, wherein the first switching element is disposed between the processor and the first color temperature output terminal, and the second switching element is disposed between the processor and the second color temperature output terminal, wherein the processor is configured to, control both the first light emitting element and the second light emitting element for an emotional light, control the third light emitting element separately from the first light emitting element and the second light emitting element for the normal light, when a first user input for adjusting a brightness of the lighting device is received via the communication interface, adjust both brightness of the first light emitting element and the second light emitting element based on the first user input, when a second user input for adjusting a color temperature is received, obtain ratio information of the brightness of the first light emitting element to the brightness of the second light emitting element based on the second user input, and adjust both brightness of the first light emitting element and the second light emitting element based on the obtained ratio information.

2. The lighting device according to claim 1, wherein the processor is configured to, when the first user input for increasing the brightness of the lighting device is received, control the brightness of the first light emitting element and the second light emitting element so as to increase both the brightness of the first light emitting element and the brightness of the second light emitting element.

3. The lighting device according to claim 1, wherein the processor is configured to, when the second user input for decreasing the color temperature is received, increase the brightness of the first light emitting element and decreasing the brightness of the second light emitting element.

4. The lighting device according to claim 1, wherein the processor is configured to, identify an entire supply current corresponding to the brightness of the lighting device based on the first user input, and supply the identified entire supply current to the first light emitting element and the second light emitting element based on the obtained ratio information.

5. The lighting device according to claim 4, wherein the processor is configured to, identify a first current supplied to the first light emitting element and a second current supplied to the second light emitting element based on the entire supply current and the ratio information, identify whether at least one of the entire supply current, the first current, or the second current is in a threshold range, and when at least one of the entire supply current, the first current, or the second current is identified to be beyond the threshold range, identify that the lighting device is broken down.

6. The lighting device according to claim 4, wherein the processor is configured to, obtain a first control signal corresponding to the first color temperature based on the entire supply current and the ratio information, obtain a second control signal corresponding to the second color temperature by inverting a waveform of the identified first control signal, transmit the first control signal to the first light emitting element, and transmit the second control signal to the second light emitting element.

7. The lighting device according to claim 6, wherein the processor is configured to, supply the first current to the first light emitting element via the first switching element based on the first control signal, and supply the second current to the second light emitting element via the second switching element based on the second control signal.

8. The lighting device according to claim 1, further comprising:

a red light emitting diode;

a green light emitting diode; and a blue light emitting diode, wherein the output terminal further comprises a red output terminal, a green output terminal, and a blue output terminal, wherein the LED positive electrode output terminal is connected to a positive electrode (anode) of the red light emitting diode, a positive electrode (anode) of the green light emitting diode, and a positive electrode (anode) of the blue light emitting diode, wherein the red output terminal is connected to a negative electrode (cathode) of the red light emitting diode, wherein the green output terminal is connected to a negative electrode (cathode) of the green light emitting diode, and wherein the blue output terminal is connected to a negative electrode (cathode) of the blue light emitting diode.

9. The lighting device according to claim 1, further comprising:

an auxiliary power supply, wherein the processor is configured to, when power of the lighting device is turned off, supply the power to the lighting device by using the auxiliary power supply.

* * * * *